US007621757B2

(12) United States Patent
Brandenburg et al.

(10) Patent No.: US 7,621,757 B2
(45) Date of Patent: Nov. 24, 2009

(54) SOLDERLESS ELECTRICAL INTERCONNECTION FOR ELECTRONIC PACKAGE

(75) Inventors: Scott D. Brandenburg, Kokomo, IN (US); Thomas A. Degenkolb, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 337 days.

(21) Appl. No.: 11/474,011

(22) Filed: Jun. 23, 2006

(65) Prior Publication Data

US 2007/0295452 A1 Dec. 27, 2007

(51) Int. Cl.
*H01R 12/00* (2006.01)

(52) U.S. Cl. ..... 439/79; 439/493; 439/67

(58) Field of Classification Search ..... 439/67, 439/79, 80, 493, 499, 736
See application file for complete search history.

(56) References Cited

U.S. PATENT DOCUMENTS 3,413,594 A * 11/1968 Fernald et al. ..... 439/637
4,639,056 A * 1/1987 Lindeman et al. ..... 439/61
5,743,747 A 4/1998 Sobhani
5,947,750 A 9/1999 Alcoe et al.
6,652,294 B1 * 11/2003 Zhang ..... 439/83
6,988,901 B2 * 1/2006 Ribeau et al. ..... 439/79
6,991,473 B1 1/2006 Balcome et al.
2003/0068905 A1 4/2003 Jensen et al.
2004/0018767 A1 1/2004 Buck et al.

FOREIGN PATENT DOCUMENTS

EP 0 622 866 11/1994
EP 0 641 038 3/1995

OTHER PUBLICATIONS

European Search Report dated Oct. 24, 2008.

* cited by examiner

*Primary Examiner*—Khiem Nguyen
(74) *Attorney, Agent, or Firm*—Jimmy L. Funke

(57) ABSTRACT

An electrical connector assembly and method of connecting an electrical connector to a substrate are provided. The electrical connector assembly includes a substrate having first electrical circuitry formed on a surface, an elastomer, and second electrical circuitry disposed at least partially between the substrate and the elastomer. Elements of the second electrical circuitry are pressed into contact with contact pads of the first electrical circuitry. The electrical connector assembly also includes a holder securing the elastomer in a compressed state to provide a pressure contact between the circuit elements and the contact pads.

20 Claims, 5 Drawing Sheets

SOLDERLESS ELECTRICAL INTERCONNECTION FOR ELECTRONIC PACKAGE

TECHNICAL FIELD

The present invention generally relates to electrical circuit connections, and more particularly relates to an electrical interconnection between a substrate and an electrical device without requiring the need for a solder joining process.

BACKGROUND OF THE INVENTION

Electronic packages commonly employ various surface mount electronic devices connected to electrical circuitry on a substrate, such as a printed circuit board. The printed circuit board generally includes a dielectric substrate in single or multiple layers and electrical circuitry typically in the form of conductive circuit traces. The circuitry also typically includes electrical conductive contact pads for making electrical connections to electrical components, such as surface mount devices. Various types of electrical connectors exist for forming the electrical connection between the surface mount components and the electrical circuitry on the substrate.

Thru-hole electrical connectors have been employed for use in automotive electronic controllers and other applications. The conventional thru-hole connector is generally reliable and robust, however, a number of disadvantages exist. With surface mount technology, many electronic packages require a solder reflow process to manufacture the circuit assembly. When using a thru-hole connector, an additional manufacturing process is typically required to mount the electrical connector to the circuit board, such as a wave or selective wave solder or pin-in-paste process. Additionally, the thru-hole connector typically consumes all layers of the circuit board and, thus, the connector footprint area generally cannot be used for other purposes.

Another conventional surface mount connector technology employs the use of gull wing-type surface mount connectors which are soldered to the surface of the circuit board. These types of connectors have been employed in the automotive environment. However, gull wing-type surface mount connectors have low shear force ratings and may experience reliability problems due to cracked solder joint interconnections between the connector leads and the printed circuit board. Additionally, the ceramic-based packages generally use a wire bonded connector header. The wire bonding process can be cumbersome and also typically adds a manufacturing process step.

It is therefore desirable to provide for a reliable electrical connection that enables electrical interconnection between the circuit board and another electrical device in a manner that is easy to manufacture. It is further desirable to provide for such an electrical connector that consumes a small amount of the substrate and does not require application of a solder connection process.

SUMMARY OF THE INVENTION

In accordance with the teachings of the present invention, an electrical connector assembly and method of assembling an electrical connector to a substrate are provided. According to one aspect of the present invention, the electrical connector assembly includes a substrate and first electrical circuitry formed on the substrate. The electrical connector assembly also has second electrical circuitry disposed at least partially on top of and in contact with the second electrical circuitry.

An elastomer is disposed at least partially on top of the second electrical circuitry and is compressible. The electrical connector assembly further includes a holder for securing the elastomer such that the elastomer is compressed to provide a pressure contact between the second electrical circuitry and the first electrical circuitry on the substrate.

According to another aspect of the present invention, an electrical connector assembly is provided that includes a substrate having first electrical circuitry including contact pads formed on a surface, an elastomer having a plurality of extensions, and a connector harness having a plurality of flexible circuit elements. The flexible circuit elements are disposed at least partially between the substrate and the plurality of extensions of the elastomer. The electrical connectors are pressed into contact with the contact pads on the substrate. The assembly further includes a holder compressing the elastomer to provide a pressure contact between the flexible circuit elements and the contact pads.

According to a further aspect of the present invention, a method of assembling an electrical connector assembly to a substrate is provided. The method includes the step of providing a substrate having first electrical circuitry formed on a surface. The method includes the step of disposing a connector assembly having second electrical circuitry such that the second electrical circuitry is aligned with the first electrical circuitry on the substrate. The method also includes the steps of applying a compressible elastomer on the second electrical connectors, and compressing the elastomer to provide a pressure contact between the second electrical circuitry and the first electrical circuitry. The method further includes the step of holding the elastomer compressed to maintain the pressure contact.

Accordingly, the electrical connector assembly and method of the present invention advantageously do not require a solder connection between the electrical circuitry on the substrate and the electrical connectors. According to some aspects, the electrical connector assembly consumes a small amount of volume, and is easy to manufacture to provide a reliable connector assembly.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
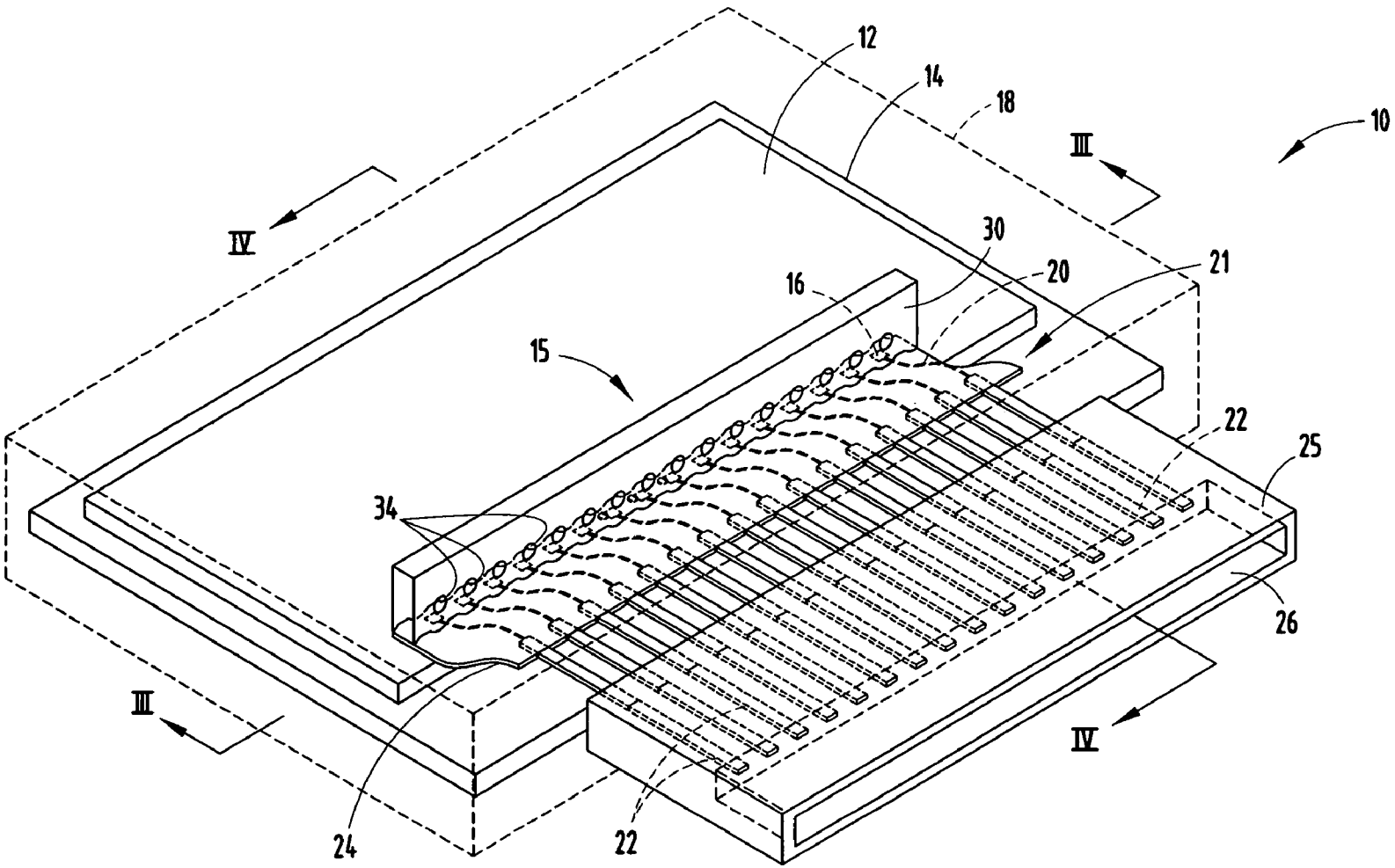
FIG. 1 is a perspective view of an electronic package employing an electrical connector assembly according to one embodiment of the present invention.
Figure 2:
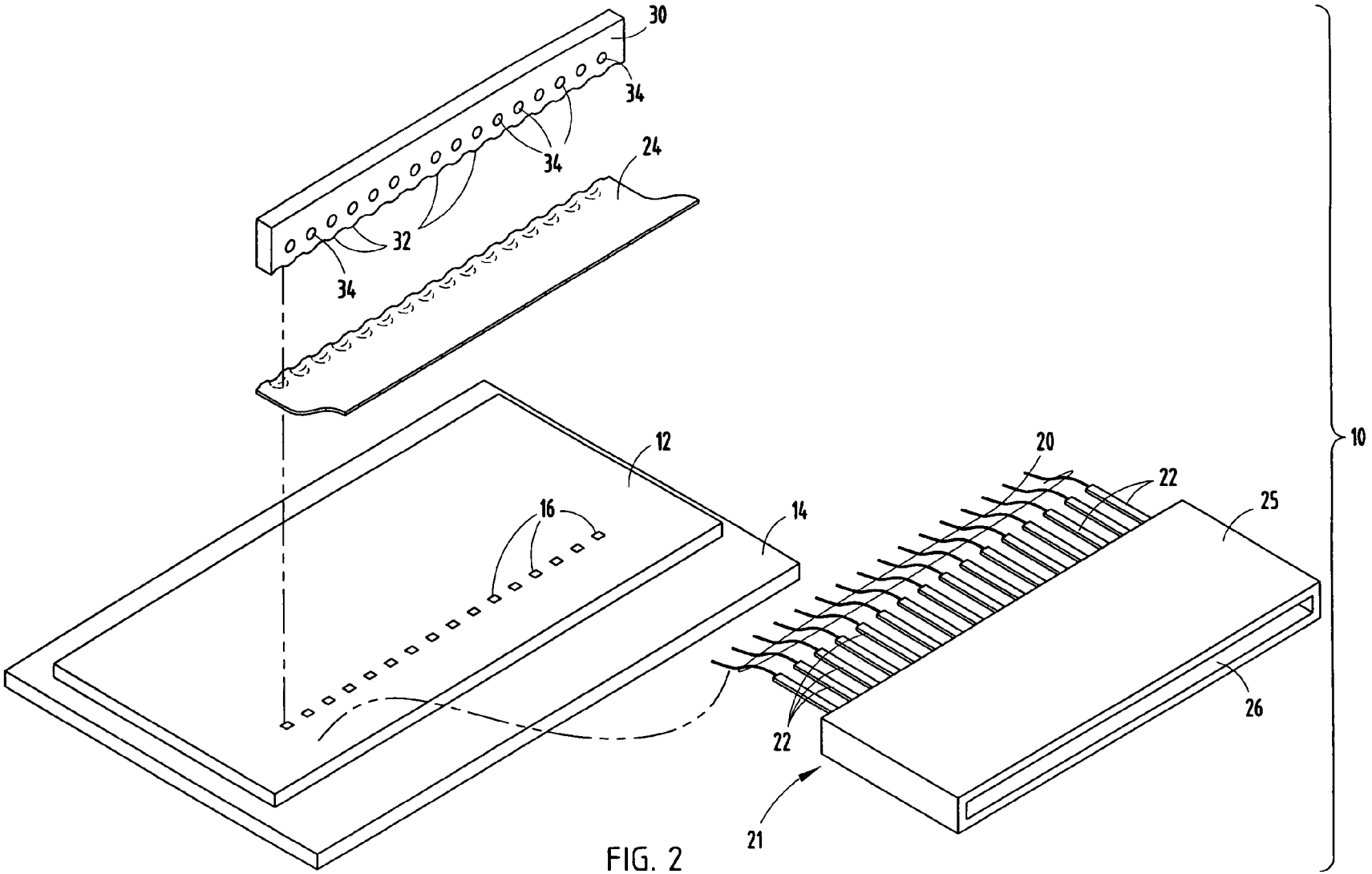
FIG. 2 is an exploded view of the electronic package shown in FIG. 1.

Referring now to FIGS. 1 and 2, an overmolded electronic package 10 is generally illustrated having an electrical connector assembly 15 including a connector harness 21 assembled onto a circuit board 12. The package 10 includes a backplate 14 and a circuit board 12 provided on top thereof. The electrical connector harness 21 connects to electrical circuitry on the circuit board 12 and provides rigid connector pins 22 that allow for connection to an external device, such as a surface mount device. The electrical connector assembly 15 enables electrical connection of any of the various types of electrical devices to the circuit board 12, without requiring a solder connection process.

The substrate 12 is shown disposed on top of backplate 14. However, the substrate 12 may be otherwise configured with or without a backplate. The substrate 12 may employ a known substrate material, such as low temperature co-fired ceramic (LTCC) or FR4, and may be a rigid or non-rigid substrate. The substrate 12, described in one exemplary embodiment as a printed circuit board, has first electrical circuitry formed on the top surface thereof including contact pads 16. The contact pads 16 have an exposed surface for contacting second electrical circuitry to form the electrical connections according to the present invention. The substrate 12 may further include electrical circuitry extending through the substrate including circuitry formed in intermediate layers and on the bottom surface. It is also contemplated that one or more electrical devices may be connected via one or more electrical connector assemblies 15 to the top, bottom and/or side walls of the substrate 12, without departing from the teachings of the present invention.

The electrical connector assembly 15 provides for easy to assemble and reliable solderless electrical connections between the circuit board 12 and other electrical device(s). The electrical connector assembly 15 includes flexible electrical circuitry shown having a plurality of flexible circuit elements 20 that are shown held together via a polyimide material 24. The flexible circuit elements 20 are disposed adjacent to and aligned with the contact pads 16 on circuit board 12, and are forced into pressure contact therewith by way of a holder compressing an elastomer 30 against the flexible circuit elements 20.

The flexible electrical circuitry 20 may include a polyimide flexible circuit, according to one embodiment. A polyimide flexible circuit can be formed using sculptured flexible circuit technology, which is commonly known to those in the art. The flexible circuitry 20 may be formed by chemically milling a sheet of copper to the shape and dimensions that are desired. A layer of polyimide film 24 is then applied to each side of the etched copper to form the flexible circuit. This enables the resulting circuitry to have rigid terminal pins 22 that are integral extensions of the thin flexible conductor elements 20. The thin flexible conductor elements 20 near one end physically contact the contact pads 16 on circuit board 12, while the rigid terminal pins 22 at the other end are shown extending within a shroud 25 having a receptacle 26 for receiving the contact terminals of another electrical device, such as a surface mount device, to form electrical connection(s) therewith. The flexible circuit elements 20, terminal pins 22, polyimide 24 and shroud 25, essentially form the wiring harness 21.

Figure 3:
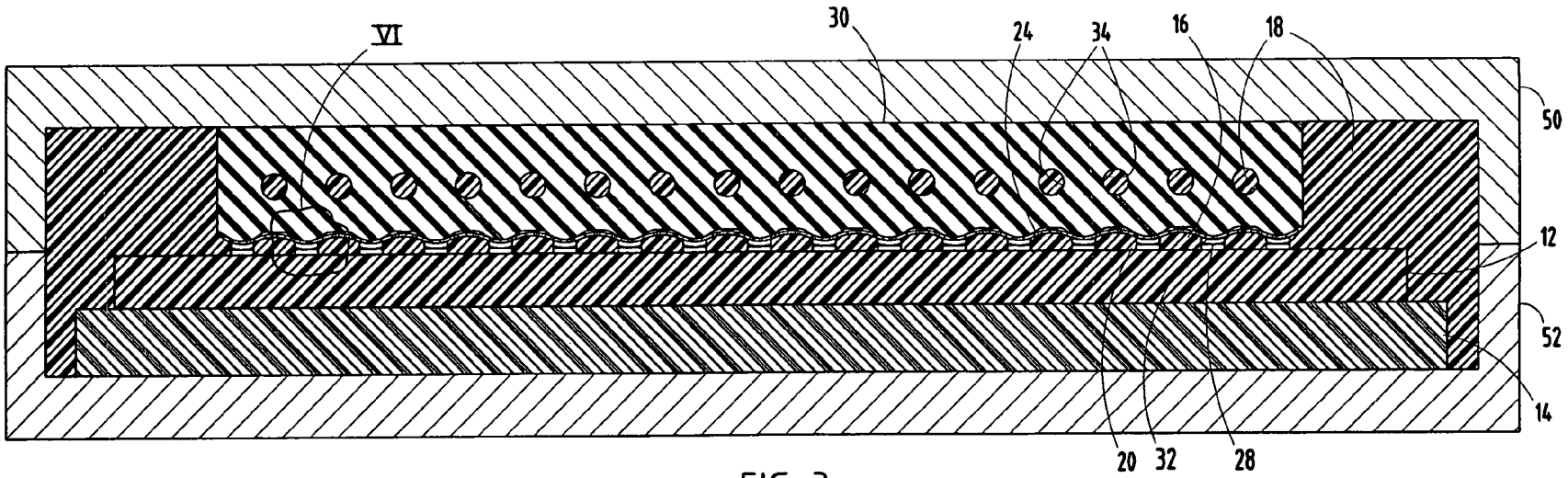
FIG. 3 is a cross-sectional view of the electronic package during the overmolding process taken through line III-III of FIG. 1.
Figure 5:
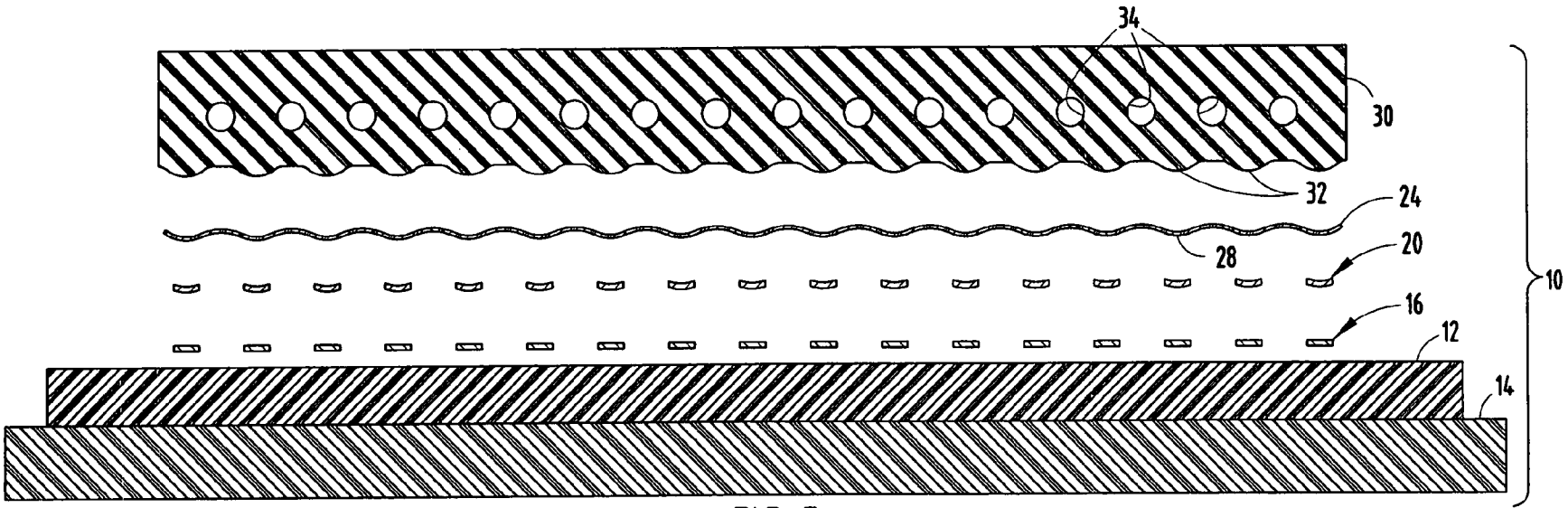
FIG. 5 is an exploded cross-sectional view of the electronic package shown in FIG. 3.
Figure 4:
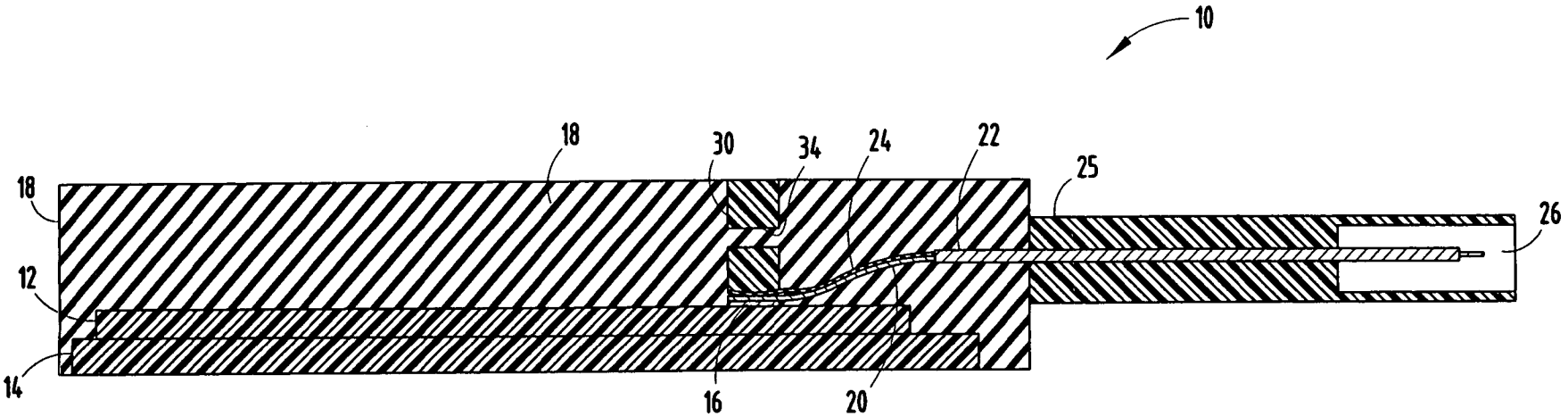
FIG. 4 is a cross-sectional view of the package taken through line IV-IV of FIG. 1.

The flexible circuit elements 20 may be formed as copper runners on the polyimide 24 layer. According to one example, the flexible circuit elements 20 may each have a thickness in the range of about two to four mils. Referring to FIGS. 3-5, the flexible circuit element 20 is shown formed having a plurality of dimples 28 at the connection locations. Each of the dimples 28 are formed extending downward at a location that is intended to make contact with a contact pad 16 on circuit board 12. The dimples 28, when compressed, become loaded under pressure and make physical contact to the respective contact pads 16. The dimples 28 essentially operate as compliant pedestals which, in combination with the remainder of the thin flexible circuit elements 20 flexes when engaged and compressed by the elastomer 30 into contact with the mating contact pad 16.

The elastomer 30 is illustrated having a plurality of downward extension members 32 for engaging the plurality of dimples 28 in each of the flexible circuit elements 20. The extension members 32 essentially extend below the main body of the elastomer 30 at locations intended to engage the dimples 28 and compress the circuit elements 20 into contact with respective contact pads 16. One example of an elastomer 30 is a silicone elastomer. The elastomer 30 is a compressible material that, when held in place, results in a compressive force that maintains pressure against the circuit elements 20 to maintain a good electrical contact with contact pads 16. The elastomer 30 also has a plurality of openings 34 extending therethrough for allowing a mold compound to enter and lock the elastomer 30 securely in place in a compressed state. The elastomer 30 may be configured in various shapes and sizes.

The electrical connector assembly 15 further includes a holder for securing the compressed elastomer 30 in place to provide a pressure contact between the flexible circuit elements 20 and the respective contact pads 16 on the circuit board 12. According to one embodiment, the holder is a mold compound 18 that essentially molds the elastomer 30 in a compressed state against the circuit board 12. In one exemplary embodiment, the mold compound 18 may include an overmolding material, such as an epoxy mold compound that bonds the assembly 15 together. The overmolding material 18 also serves to provide an overmolded package 10. The overmolding material 18 is essentially disposed in any location and shape sufficient to operate as a holder to secure the elastomer 30 in a compressed state against the substrate 12. According to one exemplary embodiment, the overmolding material 18 may be an epoxy mold compound such as thermoset materials commercially available as Cookson 200SH-01 or Henkle MG33F-0602. The overmolding material 18 essentially cures to adhere the components of the assembly together.

Figure 7:
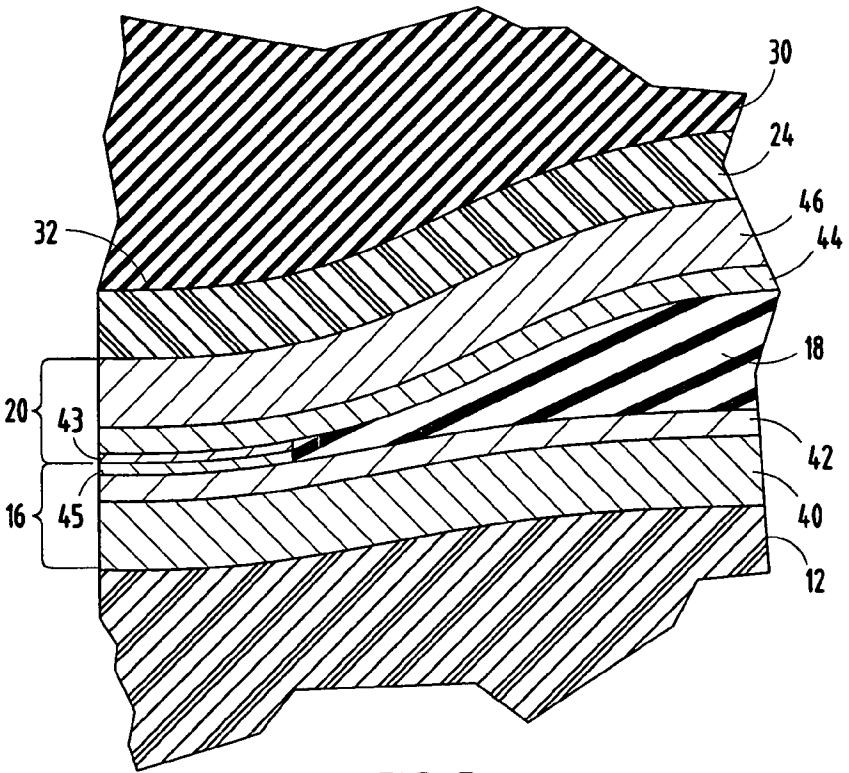
FIG. 7 is an enlarged cross-sectional view taken through line VII-VII in FIG. 6 further illustrating the electrical interconnection.
Figure 6:
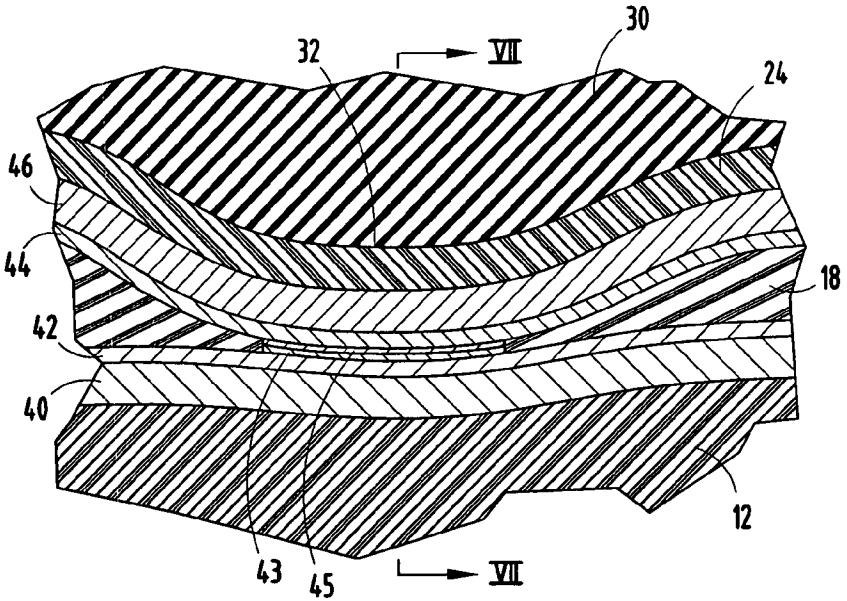
FIG. 6 is an enlarged cross-sectional view of section VI in FIG. 3 illustrating the electrical interconnection.

Referring to FIGS. 6 and 7, the electrical interconnection between the first circuitry and second circuitry is further illustrated. The first contact pad 16 of first electrical circuitry is made up of first conductive layer 40, such as copper, a second overlying layer of conductive material such as nickel, and a gold layer 45 disposed where electrical contact is to be made with the second electrical circuitry. The circuit elements 20 of the second electrical circuitry are shown having a first conductive layer 46, such as copper, a second underlying conductive layer, such as nickel, and a gold layer 43 at a location adapted to engage gold layer 45. The first and second electrical circuitry may include printed circuitry or other known electrically conductive circuit fabrication techniques. It should be appreciated that one or more gold layers, such as gold layers 43 and 45 may be provided at the electrical interconnection, on either or both of the contact pad 16 and corresponding circuit element 20 for providing an enhanced electrical conductivity.

During assembly of the overmolded package 10 and its electrical connector assembly 15, the backplate 14, circuit board 12 and connector assembly 15 are enclosed by a mold which is then filled with the mold compound. One example of a mold is illustrated surrounding package 10 in FIG. 3, and has upper and lower mold members 50 and 52 that define an overmolding cavity. The elastomer 30 is compressed by the mold members 50 and 52 to apply pressure between the flexible circuit elements 20 and contact pads 16, and a mold compound 18 is disposed in the cavity defined by the mold members 50 and 52 such that the mold compound 18 extends within any openings. The mold compound flows into openings 34 in elastomer 30 and other openings. The mold compound 18 is allowed to cure such that the elastomer 30 is held in a compressed state to maintain physical contact under compression between the circuit elements 20 and corresponding contact pads 16.

The resultant structure of the overmolded package 10 is locked together after the compound is cured. The terminal pins 22 within shroud 25 are adapted to Mattingly engage terminal connectors of another electrical device that would extend within the female receptacle 26 of shroud 25. The terminal pins 22 thereby serve to form electrical connections with other devices according to any known connector assembly.

Accordingly, the electrical connection assembly 15 according to the present invention advantageously provides for a reliable and easy to manufacture electrical connection that does not require a solder joining process. The resulting electrical connector assembly 15 consumes a small amount of space and is cost affordable.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. An electrical connector assembly comprising:

a substrate;

first electrical circuitry formed on the substrate;

second electrical circuitry disposed at least partially on top of and in contact with the second electrical circuitry;

an elastomer disposed at least partially on top of the second electrical circuitry, wherein the elastomer is compressible; and an overmolding material securing the elastomer such that the elastomer is compressed to provide a pressure contact between the second electrical circuitry and the first electrical circuitry on the substrate.

2. The electrical connector assembly as defined in claim 1, wherein the second electrical circuitry comprises flexible circuit elements.

3. The electrical connector assembly as defined in claim 1, wherein the flexible circuit elements comprise one or more dimples, wherein each dimple is aligned and in contact with the first electrical circuitry.

4. The electrical connector assembly as defined in claim 3, wherein the elastomer comprises one or more extension members for engaging the one or more dimples in the second circuitry.

5. The electrical connector assembly as defined in claim 1 further comprising a gold layer provided on at least one of the first electrical circuitry and the second electrical circuitry.

6. The electrical connector assembly as defined in claim 1, wherein the substrate comprises a printed circuit board.

7. The electrical connector assembly as defined in claim 1, wherein the overmolding material is disposed between the elastomer and the substrate.

8. The electrical connector assembly as defined in claim 1, wherein the second electrical circuitry is provided on a harness comprising a polyimide and a plurality of electrical connector pins.

9. The electrical connector assembly as defined in claim 1, wherein the first electrical circuitry comprises circuit contact pads formed on a surface of the substrate.

10. The electrical connector assembly as defined in claim 1, wherein the connection between the first electrical circuitry and second electrical circuitry is free of solder.

11. An electrical connector assembly comprising:

a substrate comprising first electrical circuitry having a plurality of contact pads;

an elastomer comprising a plurality of extension members;

a connector harness comprising second electrical circuitry having a plurality of flexible circuit elements, said flexible circuit elements disposed at least partially between the substrate and the plurality of extension members of the elastomer, wherein the flexible connector elements are pressed into contact with the contact pads on the substrate; and an overmolding material securing the elastomer in a compressed state to provide a pressure contact between the flexible connector elements and the contact pads, wherein the overmolding material is disposed between the elastomer and the substrate.

12. The electrical connector assembly as defined in claim 11, wherein the pressure contact between the flexible circuit elements and the contact pads is free of solder.

13. The electrical connector assembly as defined in claim 11, wherein the connector assembly comprises a plurality of dimples formed in the flexible circuit elements, wherein each dimple is in contact with a contact pad circuitry.

14. The electrical connector assembly as defined in claim 11 further comprising a gold layer disposed on at least one of the flexible circuit element and the contact pads.

15. The electrical connector assembly as defined in claim 11, wherein the overmolding material further extends through a plurality of openings in the elastomer.

16. A method of assembly an electrical connector assembly to contact circuitry on a substrate, said method comprising the steps of:

providing a substrate having first electrical circuitry formed on a surface;

disposing an electrical connector assembly having second electrical circuitry such that the second electrical circuitry is aligned with the first electrical circuitry on the substrate;

applying a compressible elastomer on the second electrical circuitry;

compressing the elastomer to provide a pressure contact between the second electrical circuitry and the first electrical circuitry;

applying an overmolding material to the assembly; and curing the overmolding material with the elastomer compressed to maintain the pressure contact.

17. The method as defined in claim 16, wherein the step of disposing the electrical connector assembly comprises the step of aligning electrical flexible circuit elements with a plurality of dimples, such that each dimple is arranged to be positioned in electrical contact with the first electrical circuitry.

18. The method as defined in claim 16, wherein the step of applying the overmolding material comprises applying the overmolding material disposed between the elastomer and the substrate and extending through a plurality of openings in the elastomer.

19. The method as defined in claim 16, wherein the step of disposing the electrical connector assembly comprises aligning conductive elements of the second electrical circuitry with contact pads of the first electrical circuitry.

20. The electrical connector assembly as defined in claim 1, wherein the elastomer comprises a plurality of openings and the overmolding material extends through the plurality of openings.

* * * * *